United States Patent [19]

Hiratsuka et al.

[11] Patent Number: 4,967,678

[45] Date of Patent: Nov. 6, 1990

[54] SPEED CONTROLLER FOR CONTROLLING REVOLUTION SPEED OF UPPER SHAFT OF CYCLE SEWING MACHINE

[75] Inventors: Katsuo Hiratsuka; Masanori Ayuta; Koichi Nakayama; Imao Yazaki, all of Tochigi, Japan

[73] Assignee: SSMC Inc., Edison, N.J.

[21] Appl. No.: 364,398

[22] Filed: Jun. 12, 1989

[30] Foreign Application Priority Data

Jul. 15, 1988 [JP] Japan ..... 63-93834[U]

[51] Int. Cl.[5] ..... D05B 69/16

[52] U.S. Cl. ..... 112/274

[58] Field of Search ..... 112/274, 275, 277, 459, 112/461, 463, 448, 220, 221, 67

[56] References Cited

U.S. PATENT DOCUMENTS 3,705,561 12/1972 Sakawa et al. ..... 112/67
3,908,568 9/1975 Fujii ..... 112/274 X
4,373,461 2/1983 Sano ..... 112/274

*Primary Examiner*—Peter Nerbun
*Attorney, Agent, or Firm*—Theodore Jay

[57] ABSTRACT

A speed controller for controlling revolution speed of the upper shaft of a cycle sewing machine comprises a first disk shaped stop lever adjustment cam that has a small diameter portion, middle diameter portions and a large diameter portion. The cam is rotatably driven by an upper shaft. The small diameter portion establishes a neutral position at which a first driving clutch for low speed rotation and a second driving clutch for high speed rotation are disengaged from each other. The middle portions establish a position at which the first clutch is connected to a first driving wheel for low speed rotation. The large diameter portion establishes a position at which the second clutch is connected to a second driving wheel for high speed rotation. A first end portion of the large diameter portion is defined by a second cam. The second cam is secured to the first cam by an adjustable device which can vary the circumferential position of the second cam.

3 Claims, 5 Drawing Sheets

SPEED CONTROLLER FOR CONTROLLING REVOLUTION SPEED OF UPPER SHAFT OF CYCLE SEWING MACHINE

BACKGROUND OF THE INVENTION

1. Field of the Invention:

The present invention relates to a speed controller for controlling revolution speed of an upper shaft of a cycle sewing machine.

2. Description of the Prior Art:

A prior art speed controller for controlling revolution speed of an upper shaft of a cycle sewing machine is provided with a disk shaped stop lever cam 10' having an eccentric cam member 27' as shown in FIG. 7. The stop lever cam 10' functions to control the revolution speed of the upper shaft of the cycle sewing machine and has in succession a stop interval 10'a, a low revolution speed interval l1, a high revolution speed interval l2, and a low revolution speed interval l3 whereby the upper shaft at a first end of the low revolution speed interval l1 attains a lower revolution speed in order to prevent occurrence of a condition wherein a thread threaded into a needle at the first stitch is not threaded into the cloth to be woven, this condition being defined as a first stitch omission state.

However, the prior art speed controller for controlling revolution speed of the upper shaft of the cycle sewing machine has a shortcoming in that since an eccentric cam member 27' is unadjustably fixed to the stop lever adjusting cam 10', the low revolution speed interval l1 at the first end cam can not be shortened regardless of the material to be sewn. Consequently, in order to prevent occurrence of the first stitch omission state, it is necessary to use a relatively long sewing cycle.

SUMMARY OF THE INVENTION

It is therefore an object of the present invention to provide a speed controller for controlling revolution speed of the upper shaft of the cycle sewing machine which overcomes the disadvantages of the prior art and at the same time prevents deterioration of quality and improves productivity by setting the time for one sewing cycle to a minimum period adjusted for the material and condition to be sewn.

To achieve the object of the present invention, the speed controller for controlling revolution speed of the upper shaft of the cycle sewing machine according to the present invention comprises a disk shaped stop lever adjusting cam having a small diameter section wherein a low speed drive wheel plate and a high speed drive wheel plate are disengaged from each other when this section is used, thus establishing neutral position to the periphery thereof. The cam has portions respectively continuous from the small diameter portion at a first end portion and a last end portion of the small diameter portion where the low speed drive wheel is engaged with the low speed wheel clutch plate, and a large diameter portion positioned between the middle portions opposite the small diameter portion where the high speed drive wheel is engaged with the high speed wheel clutch plate, and a displacement cam operative member attached to the large diameter portion of the stop lever adjusting cam at the first portion thereof by a fixing means which can be adjusted in the circumferential attaching position.

The above and other objects, features and advantages of the present invention will become more apparent from the following description taken in conjunction with the accompanying drawings.

BRIEF DESCRIPTION OF THE PREFERRED EMBODIMENT

A preferred embodiment of the present invention will be described with reference to FIGS. 1 to 6.

A general arrangement of the speed controller for controlling the revolution speed of the upper shaft of the cycle sewing machine will be first described with reference to FIG. 4 to 6.

Figure 4:
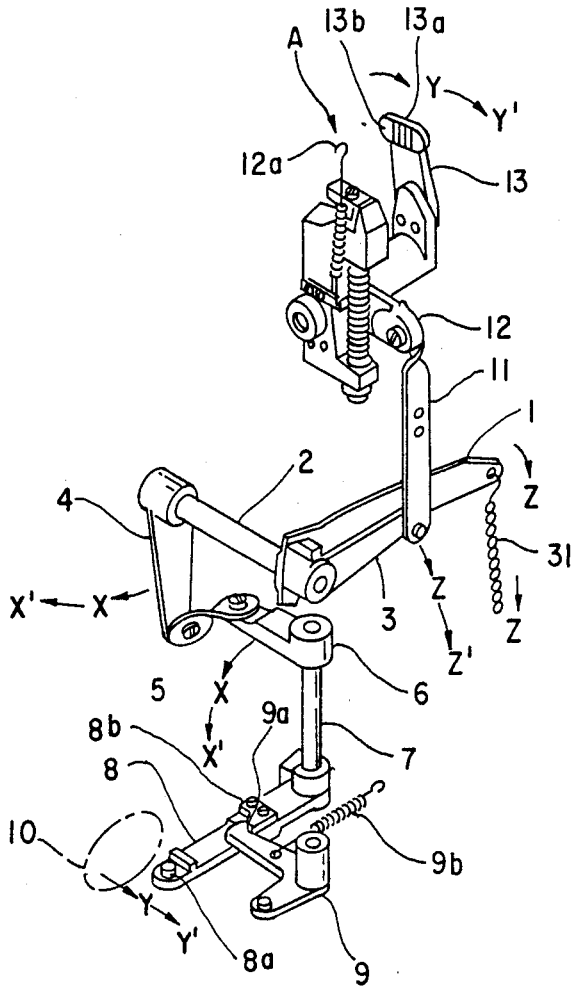
FIG. 4 is a perspective view showing an operative portion, a constituent of the speed controller according to a preferred embodiment of the present invention.
Figure 6:
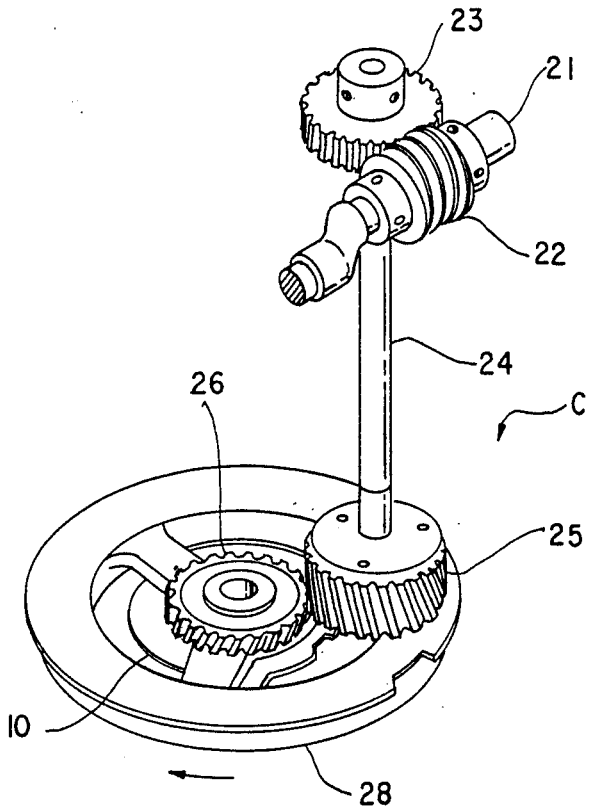
FIG. 6 is a perspective view showing a control portion, a constituent of the speed controller according to a preferred embodiment of the present invention.
Figure 5:
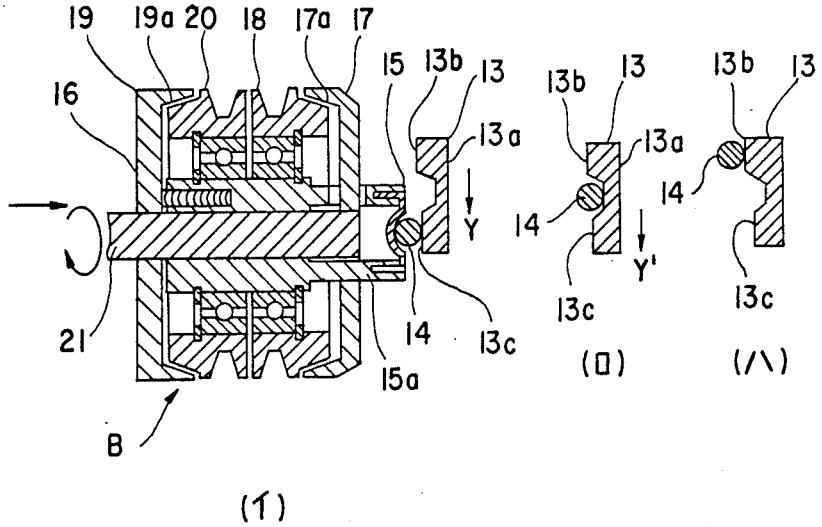
FIG. 5 is a cross sectional view showing a clutch portion, a constituent of the speed controller according to a preferred embodiment of the present invention.
Figure 7:
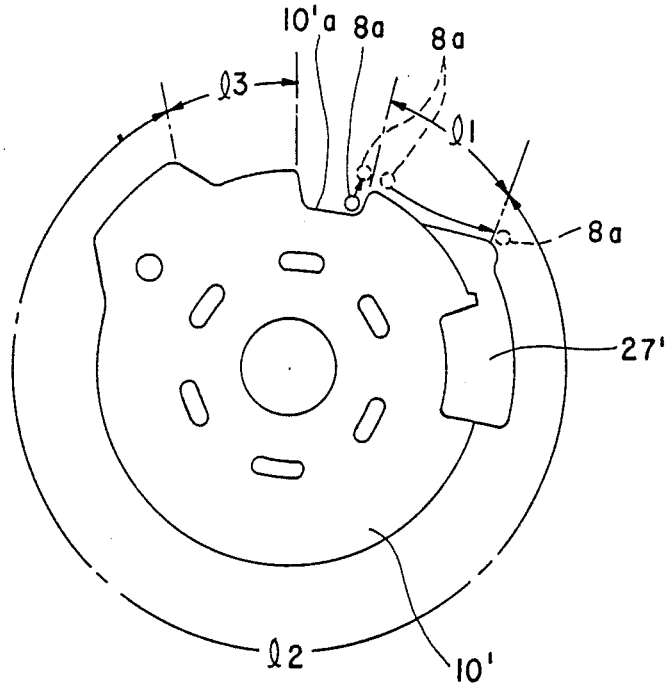
FIG. 7 is a view showing a prior art stop lever adjusting cam.

The revolution speed of the upper shaft comprises an operative portion A as shown in FIG. 4, a clutch portion B as shown in FIG. 5 and a control portion as shown in FIG. 6.

The operative portion A comprises an actuation lever 1 having a chain 31 at the base end thereof. A stop lever connection arm shaft 2 is supported by a body of the cycle sewing machine (hereinafter referred to as simply body). A first stop lever connection arm 3 is secured to the stop lever connection arm shaft 2. A second stop lever connection arm 4 is secured to the stop lever connection arm 2. A connection link 5 rotatably connects a stop lever adjusting cam 6 to the second stop lever connection arm 4. A stop lever adjusting arm shaft 7 is secured at an upper end to stop lever adjusting arm 6. A stop lever adjusting lever 8 has an end secured to the other end of the stop lever adjusting arm shaft 7. The stop lever adjusting lever 8 has a roller 8a attached at the other end portion thereof. An L-shaped block is secured at the middle portion of lever 8. A latch 9 supported by the body is rotatable around an axis parallel to the axis of the stop lever adjusting arm shaft 7. Latch 9 has a nail portion 9a engageable with the block 8b of the stop lever adjusting lever 8 for restricting the clockwise direction of the stop lever adjusting lever 8 while a spring 9b pulls the nail portion 9a into engagement with the block 8b.

The operative portion A further comprises a stop lever link 11 connected at one end thereof to the other end of the stop lever connection arm 3 by a pin. Stop lever 12 is connected to the other end of the stop lever link 11 by a pin. Stop lever 12 is connected to the other end of the stop lever link 11 by a pin and has a return spring 12a which always urges the stop lever 12 upwardly. A drive wheel plate 13 is attached on the stop lever 12 and is urged by the stop lever 12 together with the return spring 12*a* to be returned to its original position. The drive wheel adjusting plate 13 has an operative surface defined by, as shown in FIG. 5, a recess 13*a* in the central portion thereof, a high land 13*b* at the upper portion thereof, and a low land 13*c* at the lower portion thereof. Arrows in FIG. 4 at X—X', Y—Y' and Z—Z' respectively show operative directions.

With such an arrangement of the operative portion A, when a pedal fixed to the sewing machine is pressed to pull the chain 31, the following operations will be carried out.

a. The actuation lever 1 is turned in the Z-direction, causing the second stop lever connection arm 4 to turn in the X direction, the stop lever adjusting arm 6 to turn in the X direction, and the stop lever adjusting lever 8 to turn in the Y direction.

b. When the actuation lever 1 is turned in the Z direction, the drive wheel adjusting plate 13 is turned in the Y-direction via the stop lever link 11 and the stop lever 12.

The clutch portion B as shown in FIG. 5 comprises a ball receiver 15 integrally formed by a ball receiver shaft 15*a* disposed around the upper shaft 21. A ball 14 is interposed between the ball receiver 15 and the drive wheel adjusting plate 13. A compression coil 16 urges the ball receiver shaft 15*a* or the ball 14 toward the drive when adjusting plate 13. A low speed drive wheel clutch plate 17 having a conical clutch surface 17*a* and fixed to the upper shaft 21 is movable relative to the ball receiver shaft 15*a*. A high-speed drive wheel clutch plate 19 has a conical surface 19*a* and is fixed to the upper shaft 21. A low speed drive wheel 18 confronts the low speed drive wheel plate 17. A high-speed drive wheel 20 confronts the high-speed drive wheel plate 29. The low-speed and the high-speed drive wheel plates 18, 20 are rotated by a rotation drive source (not shown). The upper shaft 21 is a main shaft of the cycle sewing machine horizontally supported within the arm of the sewing machine for delivering the power to the needle bar, and the transfer unit (not shown).

The drive portion in FIG. 5 shows a first neutral position during the one sewing cycle where the ball 14 is positioned at the low land 13*c* of the drive wheel adjusting plate 13 and both the clutch surfaces 17*a*, 19*a* are disengaged from the both drive wheels 18, 20.

When the drive wheel adjusting plate 13 is turned in the Y direction to permit the ball 14 to move to the recess 13*a* and the drive wheel 18 is engaged with the drive wheel clutch plate 17, the upper shaft 21 is rotated at low speed by the drive wheel 18.

As drive wheel adjusting plate 13 continues to be turned in the Y' direction, the ball 14 reaches the high land b of the adjusting plate 13 to compress the compress spring 16. This action permits the drive wheel clutch plate 17 to be disengaged from the low speed drive wheel 18 while the high speed drive wheel 20 is engaged with the high speed drive wheel clutch plate 19 whereby the upper shaft 21 is rotated at high speed by the high speed drive wheel 20.

The control part C will be described with reference to FIG. 6.

The upper shaft 21 has a worm 22 engaged with a worm wheel 23. A cam drive shaft 24 rotatably supported by the body and has at one end thereof the worm wheel 23 and at the other end thereof a cam drive gear 25. A feed cam gear 26 is engaged with the cam drive gear 25 and is rotatably supported by the body while a feed cam 28 and the stop lever adjusting cam 10 are coaxially secured to the same shaft of the feed cam gear 26. The feed cam 26 is rotated clockwise as illustrated in FIG. 6.

The operative portion A, the clutch portion B and the control portion C are substantially the same as those of the prior art except the stop lever adjusting cam 10.

Figure 1:
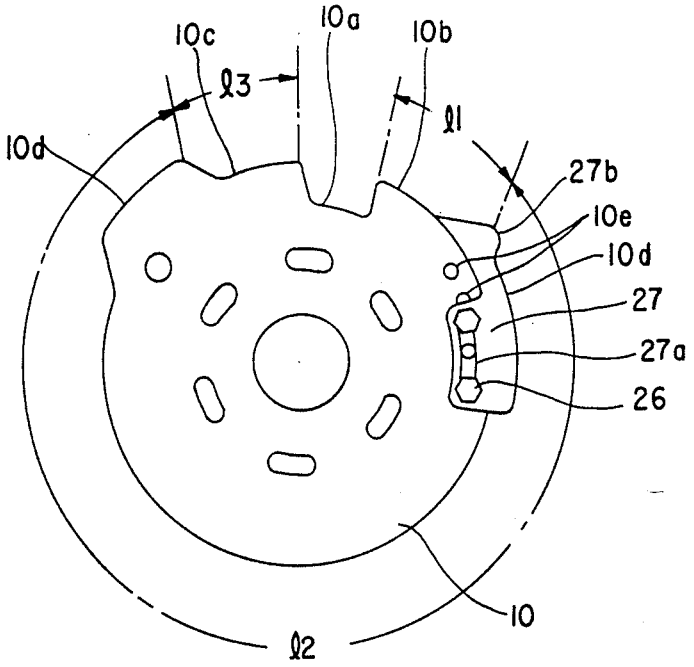
FIG. 1 is a view showing a stop lever adjusting cam employed in a speed controller according to a preferred embodiment of the present invention.
Figure 2:
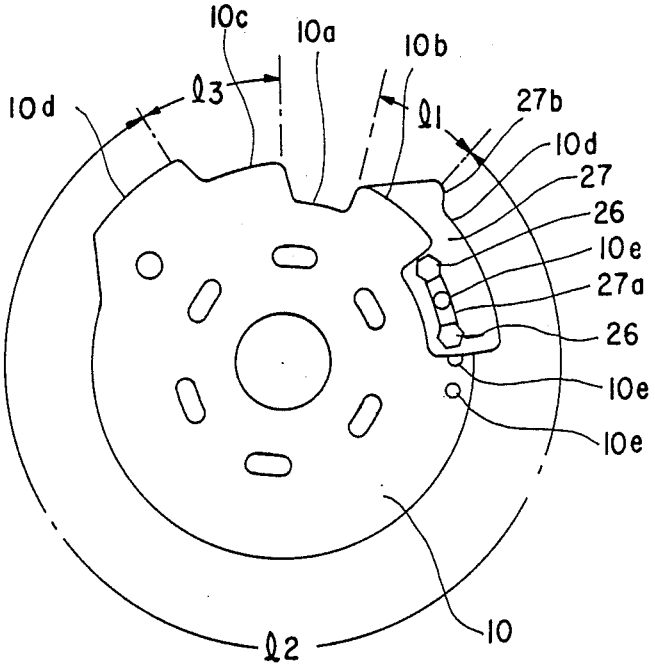
FIG. 2 is a view showing a stop lever adjusting cam in which a displacement cam actuation member is fixed to a different position from that of FIG. 1.

The stop lever adjusting cam 10 is disk shaped as shown in FIGS. 1 and 2 and has a small diameter portion 10*a* for establishing a neutral position on the periphery thereof. Middle diameter portion 10*b* is continuous from the small diameter portion 10*a* at a first end portion of the portion 10*a* to a first end portion of a large diameter portion or lobe 10*d*. Middle diameter portion 10*c* is continuous from a last end portion of the small diameter portion 10*a* to a first end portion of a displacement cam operative member 27. The large diameter portion includes lobe 10*d* and displacement cam member 27. This operative member 27 is attached to the stop lever adjusting cam 10 by a securing means which can adjust the circumferential attaching position. More in detail, a plurality of transverse holes 10*e* defined in the stop lever adjusting cam 10 in a predetermined interval are covered by the displacement cam operative member 27. Member 27 has a long hole 27*a*. Bolts and the nuts 26 are screwed into the through holes 10*e* via the long hole 27*a* whereby the displacement cam operative member 27 is attached to the stop lever adjusting cam 10. The position of the displacement cam actuation member 27 on the cam can be adjusted in the circumferential direction by the adjustment of the positions of the bolts and the nuts 26. As long as the circumferential length of the long hole 27*a* is set to be longer than the intervals of the through holes 10*e*, the displacement cam actuation member 27 can be successively adjusted as indicated.

The stop lever adjusting cam 10 will be operated in the following way.

The roller 8*a* of the stop lever adjusting lever 8 is first disposed in the small diameter portion 10*a* of the stop lever adjusting cam 10 while the ball 14 of the clutch portion B is positioned on the low land 13 so that the clutch portion B is in a neutral position.

Figure 3:
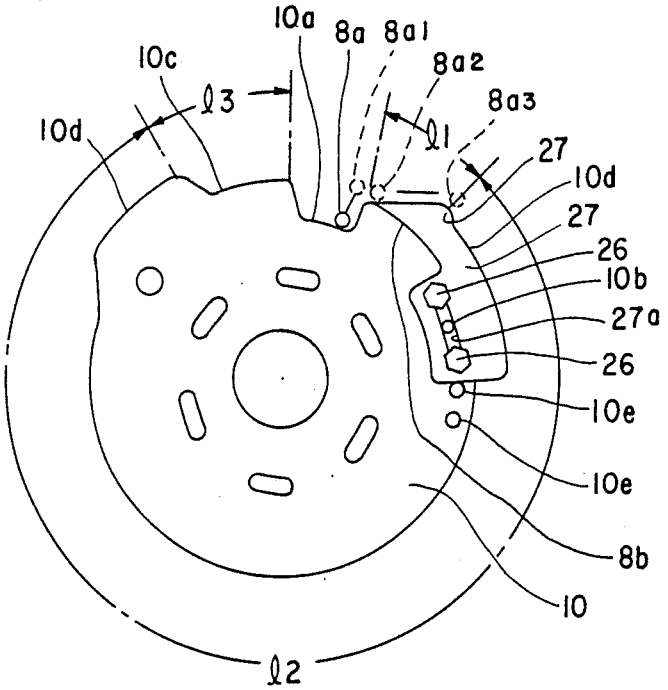
FIG. 3 is a view of assistance in explaining a stop lever adjusting cam.

At this state, the chain 31 is pulled in a small amount for a short time to permit the actuation lever 1 to turn in the Z direction whereby the stop lever adjusting lever 8 is turned to the Y direction, thereby moving the roller 8*a* from the position 8*a* to the position 8*a*1 in FIG. 3.

As the first stop lever connection arm 3 is turned in the Z direction, the drive wheel adjusting plate 3 is swung in the Y direction whereby the ball 14 is moved to the recess 13*a*, thereby permitting the low speed drive wheel clutch plate 17 to engage with the low speed drive wheel 18 and rotate the upper shaft 21 at the low speed. During the low speed revolution of the upper shaft 21, the material to be sewn (not shown) is sewn at the low speed, (interval l1) thus preventing the appearance of the first stitch omission state.

The revolution of the upper shaft 21 is transferred to the feed cam gear 26, thereby rotating the stop lever adjusting cam 10 and the feed cam 28 clockwise at the low speed. At this point, the roller 8*a* moves from the position 8*a*1 to the position 8*a*2 whereby the middle portion 10*b* at the first end thereof contacts, then moves along, an inclination surface of the displacement cam operative member 27 at the first end thereof, and reaches the position 8*a*3.

When the roller 8a reaches the maximum diameter portion 27b (the position 8a3) of the displacement cam operative member 27, the stop lever 8 is turned to some considerable extent in Y' direction to permit the nail portion 9a of the latch to be safely retained by the block 8b, while the stop lever link 11 is turned in the Z' direction. As a result, the drive wheel adjusting plate 13 is swung to the Y' direction so that the ball 14 of the clutch portion B is positioned in the high land 13b thereby permitting the high speed drive wheel clutch plate 19 to be engaged with the high speed drive wheel 20 whereby the shaft 21 is rotated at high speed. As a result of the high speed revolution of the upper shaft 21, the stop lever adjusting cam 10 and the feed cam 28 are also rotated at high speed. The material to be sewn is subjected to sewing operation at high speed. Until the roller 8a reaches the large diameter portion 10d at the second end after moving away from the operative member 27, the nail portion 9a of the latch is retained by the block 8b.

The low speed interval l1 can be shortened or lengthened by adjusting the circumferential position of the displacement cam operative member 27 with respect to the stop lever adjusting cam 10. For example, the low speed interval l1 can be lengthened and the high speed interval l2 can be shortened by enlarging the middle portion at the first end side of the stop lever adjusting cam 10 as shown in FIG. 1 or the low speed interval l1 can be shortened and the high speed interval l2 can be lengthened by covering almost the middle diameter portion 10b at the first end side of the stop lever adjusting cam 10 by the displacement cam operative member 27.

The retention of the nail portion 9a by the block 8b can be released by a large diameter portion (not shown) of the feed cam 28 just before reaching the low speed interval 13 at the last end side of the stop lever adjusting cam 10, namely, at the time when the roller 8a is positioned to the large diameter portion 10d at the last end side of the stop lever adjusting cam 10. The low speed interval l3 given by the middle portion 10c at the last end side of the stop lever adjusting cam 10 is not changed according to the present invention.

Although the large diameter portion 10d of the stop lever adjusting cam 10 is defined only at the first and the last ends of the high speed interval l2 while at the interval between both large diameter portions 10d, 10d the nail portion 9a of the latch is retained by the block 8b to keep the high speed interval l2, the large diameter portion 10d can be defined at the whole interval of the high speed interval l2 with the first end side thereof being defined by the displacement cam operative member 27.

The arrangement of the speed controller for controlling revolution speed of the upper shaft of the cycle sewing machine as set forth above makes use of the stop lever adjusting cam having a single displacement cam operative member to change the low speed revolution interval of the upper shaft of the cycle sewing machine. Consequently, the deterioration of quality of the material to be sewn caused by the first stitch omission state can be prevented by adjusting the time for one sewing cycle for a minimum term fitted for the material and condition to be sewn, thus improving the productivity.

Although the invention has been described in its preferred form with a certain degree of particularity, it is to be understood that many variations and changes are possible in the invention without departing from the scope thereof.

What is claimed is:

1. A speed controller for controlling revolution speed of an upper shaft of a cycle sewing machine comprising:

an upper shaft horizontally supported within the arm of a cycle sewing machine and serving as a main shaft of the cycle sewing machine;

an operative portion fixed to the body of the cycle sewing machine and having a stop lever adjusting lever provided with a roller at an end portion thereof and a drive wheel adjusting plate at the upper portion thereof;

a clutch portion comprising a ball receiver integrally formed by a ball receiver shaft and provided around the upper shaft, a ball positioned between the ball receiver and the drive wheel adjusting plate, a low speed drive wheel clutch plate fixed to the upper shaft movable relative to the ball receiver shaft, a high speed drive wheel clutch plate fixed to the upper shaft, a low speed drive wheel confronted with the low speed drive wheel plate, a high speed drive wheel confronted with the high speed drive wheel plate;

a control part having a feed cam gear engaged with a cam drive gear to which a revolution of the upper shaft is delivered; and a stop lever adjusting cam coaxially fixed to the shaft of the feed cam gear;

characterized in that the stop lever adjusting cam has a small diameter portion where the low speed drive wheel plate and the high speed drive wheel plate are disengaged from each other for giving a neutral position to the periphery thereof, middle diameter portions respectively continuous from the small diameter portion at a first end portion and a last end portion of the small diameter portion where the low speed drive wheel is engaged with the low speed wheel clutch plate, and a large diameter portion positioned between the middle portions opposite the small diameter portion where the high speed drive wheel is engaged with the high speed wheel clutch plate, and a displacement cam operative member attached to the large diameter portion of the stop lever adjusting cam at the first portion thereof by a fixing means which can be adjusted in the circumferential attaching position.

2. A speed controller for controlling revolution speed of an upper shaft of the cycle sewing machine according to claim 1, wherein the fixing means comprises a plurality of through holes defined in the stop lever adjusting cam in a predetermined interval which are covered by the displacement cam operative member having a long hole while the bolts and the nuts are screwed into the through holes via the long hole whereby the displacement cam operative member is attached to the stop lever adjusting cam.

3. A speed controller for controlling revolution speed of an upper shaft of the cycle sewing machine according to claim 2, wherein circumferential length of the long hole is set to be longer than the intervals of the through holes so that the displacement cam operative member can be successively adjusted.

* * * * *